US008730147B2

(12) United States Patent
Shimura

(10) Patent No.: US 8,730,147 B2
(45) Date of Patent: May 20, 2014

(54) BACKLIGHT CONTROL CIRCUIT, BACKLIGHT DEVICE, AND LIQUID CRYSTAL DISPLAY INCLUDING THE SAME

(75) Inventor: Tatsuhisa Shimura, Tokyo (JP)

(73) Assignee: Samsung Display Co., Ltd. (KR)

( * ) Notice: Subject to any disclaimer, the term of this patent is extended or adjusted under 35 U.S.C. 154(b) by 1250 days.

(21) Appl. No.: 12/243,470

(22) Filed: Oct. 1, 2008

(65) Prior Publication Data

US 2009/0213063 A1 Aug. 27, 2009

(30) Foreign Application Priority Data

Feb. 21, 2008 (KR) ..... 10-2008-0015849

(51) Int. Cl.
*G09G 3/36* (2006.01)

(52) U.S. Cl.
USPC ..... 345/102; 345/690; 345/204

(58) Field of Classification Search
USPC ..... 345/102
See application file for complete search history.

(56) References Cited

U.S. PATENT DOCUMENTS 7,652,517 B2 * 1/2010 Corcelli ..... 327/295
2004/0056825 A1 * 3/2004 Min et al. ..... 345/38
2006/0077288 A1 * 4/2006 Wu ..... 348/441
2006/0262107 A1 * 11/2006 Feuchtgruber et al. ..... 345/204
2010/0052544 A1 * 3/2010 Park et al. ..... 315/149

FOREIGN PATENT DOCUMENTS

JP 11202286 A 7/1999
JP 11249616 9/1999
JP 2000292767 * 10/2000 ..... G02F 1/133
JP 2001312246 A 11/2001
JP 2004191675 A 7/2004
JP 2007086752 A 4/2007
JP 2007256496 A 10/2007
JP 2007322649 A 12/2007
KR 1020040021400 3/2004

* cited by examiner

*Primary Examiner* — Sumati Lefkowitz
*Assistant Examiner* — Jose Soto Lopez
(74) *Attorney, Agent, or Firm* — Cantor Colburn LLP

(57) ABSTRACT

A backlight control circuit includes a shift register, first and second dividers, a counter/decoder, data registers and control signal generators. The shift register stores digital video data based on a transmission clock signal. The first and second dividers divide the transmission clock signal to generate first and second clock signals, respectively. The counter/decoder counts a number of pulses of the first clock signal and outputs a decoding signal. The decoding signal is used to set an output timing of the digital video data stored in the shift register. The data registers receive and store the digital video data stored in the shift register based on the decoding signal. The control signal generators generate brightness control signals based on the second clock signal in response to the digital video data stored in the data registers to locally control a brightness of light sources of a plurality of light sources.

10 Claims, 12 Drawing Sheets

BACKLIGHT CONTROL CIRCUIT, BACKLIGHT DEVICE, AND LIQUID CRYSTAL DISPLAY INCLUDING THE SAME

This application claims priority to Korean Patent Application No. 2008-15849, filed on Feb. 21, 2008, and all the benefits accruing therefrom under 35 U.S.C. §119, the contents of which in its entirety are herein incorporated by reference.

BACKGROUND OF THE INVENTION

1. Field of the Invention

The present invention relates to a backlight control circuit and, more particularly, to a backlight control circuit which controls a backlight used as a light source in a liquid crystal display, a backlight device equipped with the backlight control circuit, and the liquid crystal display including the same.

2. Description of the Related Art

In general, there is a continual need for liquid crystal displays ("LCDs") which have lighter weight, slimness and low power consumption requirements. Since the LCD is a non-emissive device, a separate light source is necessary, however. As a result, a cold cathode fluorescent lamp ("CCFL") or, alternatively, a backlight unit which includes light emitting diodes ("LEDs") has been used as the separate light source in the LCD.

FIG. 1 is a block diagram of a liquid crystal display of the prior art.

The liquid crystal display 1 of the prior art includes a controller 2 including a timing control circuit 3 and a control logic circuit 4, a backlight control unit 5, a backlight unit 6 and a liquid crystal display panel 7.

The timing control circuit 3 controls transmission timing to transmit digital video data corresponding to a video signal from an external circuit to circuits provided after the control logic circuit 4.

More specifically, the control logic circuit 4 generates the digital video data corresponding to the video signal to transmit the digital video data to the backlight control unit 5 and the LCD panel 7 based on the transmission timing set by the timing control circuit 3. In addition, the control logic circuit 4 generates a vertical synchronization signal, a horizontal synchronization signal, a clock signal and a load signal, for example, (described in greater detail below with reference to FIG. 2) to output the abovementioned signals to the backlight control unit 5 based on the transmission timing set by the timing control circuit 3.

The backlight control unit 5 generates an internal load pulse signal data.o, and a pulse width modulation ("PWM") pulse signal which is used to locally control a brightness of a plurality of light sources provided inside the backlight unit 6, based on the vertical synchronization signal, the horizontal synchronization signal, the clock signal and the load signal, for example, which are provided from the control logic circuit 4. The backlight unit 6 includes a plurality of LEDs (not shown) as the plurality of light sources, and the brightness of the plurality of light sources is locally controlled by the PWM pulse signal input from the backlight control unit 5.

The LCD panel 7 includes a thin film transistor ("TFT") liquid crystal panel (not shown) to display an image, e.g., a video image, in response to the digital video data input from the control logic circuit 4.

FIG. 2 is a block diagram which illustrates connections between a control logic circuit of the prior art and a backlight control unit of the prior art.

Referring to FIG. 2, the control logic circuit 4 is electrically connected to the backlight control unit 5 through five external interconnections therebetween. The five external interconnections serially transmit a vertical synchronization signal v.sync, a horizontal synchronization signal h.sync, a serial transmission clock signal CLK, a digital video data DT and a load signal LD from the control logic circuit 4 to the backlight control unit 5. The backlight control unit 5 may include a plurality of backlight control circuits 5*a* to 5*j* (described in greater detail below with reference to FIG. 4).

FIG. 3 is a block diagram of an internal structure of a backlight control circuit of the prior art.

Referring to FIG. 3, a backlight control circuit 5*a* includes a shift register 51, a buffer register 52, a plurality of data registers 53*a* to 53*f*, a plurality of PWM generators 54*a* to 54*f*, a counter/decoder 55 and an oscillator 56.

The shift register 51 stores the digital video data DT at predetermined timing interval based on the serial transmission clock signal CLK. The buffer register 52 transmits the digital video data DT, which has been stored in the shift register 51, to data registers 53*a* to 53*f* of the plurality of data registers 53*a* to 53*f*, connected in electrical parallel with each other, at a timing set by the load signal LD. The counter/decoder 55 counts a number of pulses of the horizontal synchronization signal h.sync input as a clock signal clk, and transmits a decoding signal 1*d* obtained by decoding a count value of the abovementioned number of pulses to the data registers 53*a* to 53*f*. In addition, the counter/decoder 55 receives the vertical synchronization signal v.sync as a reset pulse rst to initialize the count value. The oscillator 56 receives the vertical synchronization signal v.sync from the counter/decoder 55, generates a reference clock signal clk2 used to generate PWM pulse signals PWM0 to PWM5 corresponding to the digital video data DT loaded into the data registers 53*a* to 53*f*, respectively, and provides the reference clock signal clk2 to PWM generators 54*a* to 54*f* of the plurality of PWM generators 54*a* to 54*f*. The data registers 53*a* to 53*f* load the digital video data DT from the buffer register 52 at the timing of the decoding signals 1*d* transmitted from the counter/decoder 55. The PWM generators 54*a* to 54*f* generate the PWM pulse signals PWM0 to PWM5, respectively, which correspond to the digital video data DT loaded into the data registers 53*a* to 53*f*, respectively, based on the reference clock signal clk2 provided from the oscillator 56.

FIG. 4 is a block diagram of an internal structure of a backlight control unit of the prior art including the backlight control circuit 5*a* of the prior art shown in FIG. 3.

Referring to FIG. 4, the backlight control unit 5 includes the plurality of backlight control circuits 5*a* to 5*j*, as described above. The backlight control circuits 5*b* to 5*j* of the plurality of backlight control circuits 5*b* to 5*j* each have a structure substantially the same as shown in FIG. 3 and described in greater detail above. The backlight control unit 5 classifies, e.g., groups or divides, light sources of the plurality light sources inside the backlight unit 6 into 10×8 local blocks, for example, to control brightness of each of the local blocks. Further, in the backlight control unit 5, the backlight control circuits 5*a* to 5*j* each have eight output lines to output the PWM pulse signals, and are electrically connected to each other through five signal lines to transmit respective signals (the vertical synchronization signal v.sync, the horizontal synchronization signal h.sync, the serial transmission clock signal CLK, the digital video data DT and the load signal LD associated with each of the backlight control circuits 5*b* to 5*j*, for example). In the backlight control unit 5, the backlight control circuits 5*a* to 5*j* perform a local dimming control. More specifically, the backlight control circuits 5*a* to 5*j* output the PWM pulse signals to control turn-on/turn-off operations of the light sources provided inside the backlight unit 6 by classifying the light sources into the 10×8 local blocks, and to control the brightness of each of the light sources by controlling the brightness of each of the local blocks.

In addition, the liquid crystal display 1 transmits approximately 100 (one hundred) 10-bit digital video data corresponding to the video signal for every one frame (e.g., for every approximately 16.7 ms to approximately 8.3 ms, depending upon a frame rate of the liquid crystal display). Accordingly, approximately one hundred 10-bit digital video data are serially transmitted between the control logic circuit 4 and the backlight control unit 5 (FIG. 2) for every one frame. However, the control logic circuit 4 and the backlight control unit 5 in the liquid crystal display of the prior art are mounted on different printed circuit boards ("PCBs"). As a result, external interconnections connecting the different printed circuit boards to each other are required. Further, a serial transmission scheme is thereby required to reduce a number of the external interconnections.

Referring again to FIGS. 1 to 4, the backlight control unit 5 generates the PWM pulse signals according to the digital video data DT corresponding to the video signal based on the reference clock signal clk2, which is generated from the oscillator 56 included in each backlight control circuit 5*a* to 5*j*, and the brightness of the light sources of the backlight unit 6 is controlled by local blocks in response to the video signal. The reference clock signal clk2 generated from the oscillator 56 is different from the vertical synchronization signal v.sync used to transmit the video signal. Accordingly, a timing to control the display of a video is asynchronous with respect to a timing to control the brightness of the backlight unit 6. As a result, a quality of a video displayed on the LCD panel 7 is degraded.

Accordingly, in order to avoid such an asynchronous state, an additional circuit such as a phase locked loop ("PLL") circuit is required in the backlight control unit 5 of the prior art to correct a synchronization time difference between the reference clock signal clk2 and the vertical synchronization signal v.sync. However, such an additional component, e.g., the PLL, provided in the backlight control unit 5 increases a manufacturing cost of the backlight control unit 5 of the prior art. Further, the additional component increases a manufacturing cost of a backlight device including the backlight control unit 5 and a liquid crystal display including the backlight device.

As shown in FIG. 2, the control logic circuit 4 is connected to the backlight control unit 5 through the connections therebetween. A reduction of a number of the interconnections between circuit blocks is a very important factor considered in circuit design. Accordingly, it is also desired to reduce a number of external interconnections connecting the control logic circuit 4 to the backlight control unit 5.

BRIEF SUMMARY OF THE INVENTION

An exemplary embodiment of the present invention provides a backlight control circuit which has a reduced number of circuit components required in a backlight control unit, as well as a reduced number of external interconnections required for the backlight control unit.

An alternative exemplary embodiment of the present invention provides a backlight device including the backlight control circuit.

Yet another alternative exemplary embodiment of the present invention provides a liquid crystal display including the backlight device.

A backlight control circuit according to an exemplary embodiment of the present invention controls a backlight unit including a plurality of light sources which emits light. The backlight control circuit includes a shift register which receives and stores digital video data based on a transmission clock signal, the digital video data based on a video signal having a predetermined period. The backlight control circuit further includes a first divider which divides the transmission clock signal to generate a first clock signal, and a counter/decoder which initializes a count value based on a vertical synchronization signal, counts a number of pulses of the first clock signal, and outputs a decoding signal obtained by decoding the count value obtained by counting the number of the pulses, wherein the decoding signal is used to set an output timing of the digital video data stored in the shift register. The backlight control circuit further includes a plurality of data registers which receives and stores the digital video data stored in the shift register based on the decoding signal, a second divider which divides the transmission clock signal to generate a second clock signal, and a plurality of control signal generators which generates brightness control signals based on the second clock signal in response to the digital video data stored in the data registers to locally control a brightness of light sources of the plurality of light sources.

The shift register receives the digital video data corresponding to one frame to transmit the digital video data corresponding to the one frame to the plurality of data registers, the plurality of data registers divides and stores the digital video data corresponding to the one frame, and the plurality of control signal generators generates the brightness control signals based on the second clock signal in response to the digital video data stored in the plurality of data registers to locally control the brightness of blocks the light sources.

The brightness control signals may include a pulse width modulation signal having a pulse shape and a pulse width controlled by the plurality of control signal generators.

In addition, a plurality of external interconnections may be connected to the control signal generators and may receive the transmission clock signal, the digital video data and the vertical synchronization signal.

A backlight device according to an alternative exemplary embodiment of the present invention includes a backlight unit including a plurality of light sources. The backlight device further includes a plurality of backlight control circuits which locally control a brightness of blocks of light sources of the plurality of light sources.

Backlight control circuits of the plurality thereof include a shift register which receives and stores digital video data based on a transmission clock signal, the digital video data based on a video signal having a predetermined period, a first divider which divides the transmission clock signal to generate a first clock signal, and a counter/decoder which initializes a count value based on a vertical synchronization signal, counts a number of pulses of the first clock signal, and outputs a decoding signal obtained by decoding the count value obtained by counting the number of the pulses wherein the decoding signal is used to set an output timing of the digital video data stored in the shift register. The backlight control circuits further include a plurality of data registers which receives and stores the digital video data stored in the shift register based on the decoding signal, a second divider which divides the transmission clock signal to generate a second clock signal, and a plurality of control signal generators which generates brightness control signals based on the second clock signal in response to the digital video data stored in the data registers to locally control the brightness of the blocks of light sources.

The backlight control circuits may be connected to each other through external interconnections which transmit the transmission clock signal, the digital video data and the vertical synchronization signal.

According to another alternative exemplary embodiment of the present invention, a liquid crystal display includes: a backlight unit including a plurality of light sources which projects light; a plurality of backlight control circuits which locally controls brightness of blocks of light sources of the plurality of light sources; and a liquid crystal display panel which displays a video with the light.

Each of the backlight control circuit comprises: a shift register which receives and stores digital video data based on a transmission clock signal, the digital video data based on a video signal having a predetermined period; a first divider which divides the transmission clock signal to generate a first clock signal; a counter/decoder which initializes a count value based on a vertical synchronization signal, counts a number of pulses of the first clock signal, and outputs a decoding signal obtained by decoding the count value obtained by counting the number of the pulses, wherein the decoding signal is used to set an output timing of the digital video data stored in the shift register; a plurality of data registers which receives and stores the digital video data stored in the shift register based on the decoding signal; a second divider which divides the transmission clock signal to generate a second clock signal; and a plurality of control signal generators which generates brightness control signals based on the second clock signal in response to the digital video data stored in the data registers to locally control the brightness of the blocks of light sources.

According to yet another alternative exemplary embodiment of the present invention, a liquid crystal display includes a liquid crystal display panel which displays a video using light and a backlight device which emits the light.

The backlight device includes: a backlight unit including a plurality of light sources; a shift register which receives and stores digital video data based on a transmission clock signal, the digital video data based on a video signal having a predetermined period; a first divider which divides the transmission clock signal to generate a first clock signal; a counter/decoder which initializes a count value based on a vertical synchronization signal, counts a number of pulses of the first clock signal, and outputs a decoding signal obtained by decoding the count value obtained by counting the number of the pulses, wherein the decoding signal is used to set an output timing of the digital video data stored in the shift register; a plurality of data registers which receives and stores the digital video data stored in the shift register based on the decoding signal; a second divider which divides the transmission clock signal to generate a second clock signal; and a plurality of control signal generators which generates brightness control signals based on the second clock signal in response to the digital video data stored in the data registers to locally control a brightness of blocks of light sources of the plurality of light sources.

A liquid crystal display according to still another alternative exemplary embodiment of the present invention includes: a display unit which includes a liquid crystal display panel, data circuits connected to the liquid crystal display panel, and gate circuits connected to the liquid crystal display panel; a backlight unit; a container which receives the backlight assembly; and a top chassis which surrounds a peripheral edge of the liquid crystal display panel and is connected to the container, to prevent the liquid crystal display panel from being damaged. The liquid crystal display further includes at least one optical sheet disposed between the liquid crystal display panel and the backlight assembly, and a backlight control circuit which controls the backlight unit. The backlight control circuit includes: a shift register which receives and stores digital video data based on a transmission clock signal, the digital video data based on a video signal having a predetermined period; a first divider which divides the transmission clock signal to generate a first clock signal; a counter/decoder which initializes the count value based on a vertical synchronization signal, counts a number of pulses of the first clock signal, and outputs a decoding signal obtained by decoding the count value obtained by counting the number of the pulses, wherein the decoding signal is used to set an output timing of the digital video data stored in the shift register; a plurality of data registers which receives and stores the digital video data stored in the shift register based on the decoding signal; a second divider which divides the transmission clock signal to generate a second clock signal; and a plurality of control signal generators which generates brightness control signals based on the second clock signal in response to the digital video data stored in the data registers to locally control a brightness of blocks of light sources of the plurality of light sources.

In yet another alternative exemplary embodiment of the present invention, a liquid crystal display includes a display unit, the display unit including: a liquid crystal display panel; data circuits connected to the liquid crystal display panel; and gate circuits connected to the liquid crystal display panel.

The liquid crystal display further includes a backlight device including a backlight unit including a plurality of light sources and a plurality of backlight control circuits which locally control a brightness of blocks of light sources of the plurality of light sources. The backlight control circuits of the plurality of backlight control circuit include: a shift register which receives and stores digital video data based on a transmission clock signal, the digital video data based on a video signal having a predetermined period; a first divider which divides the transmission clock signal to generate a first clock signal; a counter/decoder which initializes a count value based on a vertical synchronization signal, counts a number of pulses of the first clock signal, and outputs a decoding signal obtained by decoding the count value obtained by counting the number of pulses, wherein the decoding signal is used to set an output timing of the digital video data stored in the shift register; a plurality of data registers which receives and stores the digital video data stored in the shift register based on the decoding signal; a second divider which divides the transmission clock signal to generate a second clock signal; and a plurality of control signal generators which generates brightness control signals based on the second clock signal in response to the digital video data stored in the data registers to locally control the brightness of the blocks of light sources.

Thus, a number of components and/or external interconnections required in a backlight control circuit is substantially reduced in the backlight control circuit according to an exemplary embodiment of the present invention. Further, the backlight control circuit according to an exemplary embodiment of the present invention controls a brightness of a plurality of light sources in the backlight unit by controlling a brightness of each local block of light sources within the plurality of light sources.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
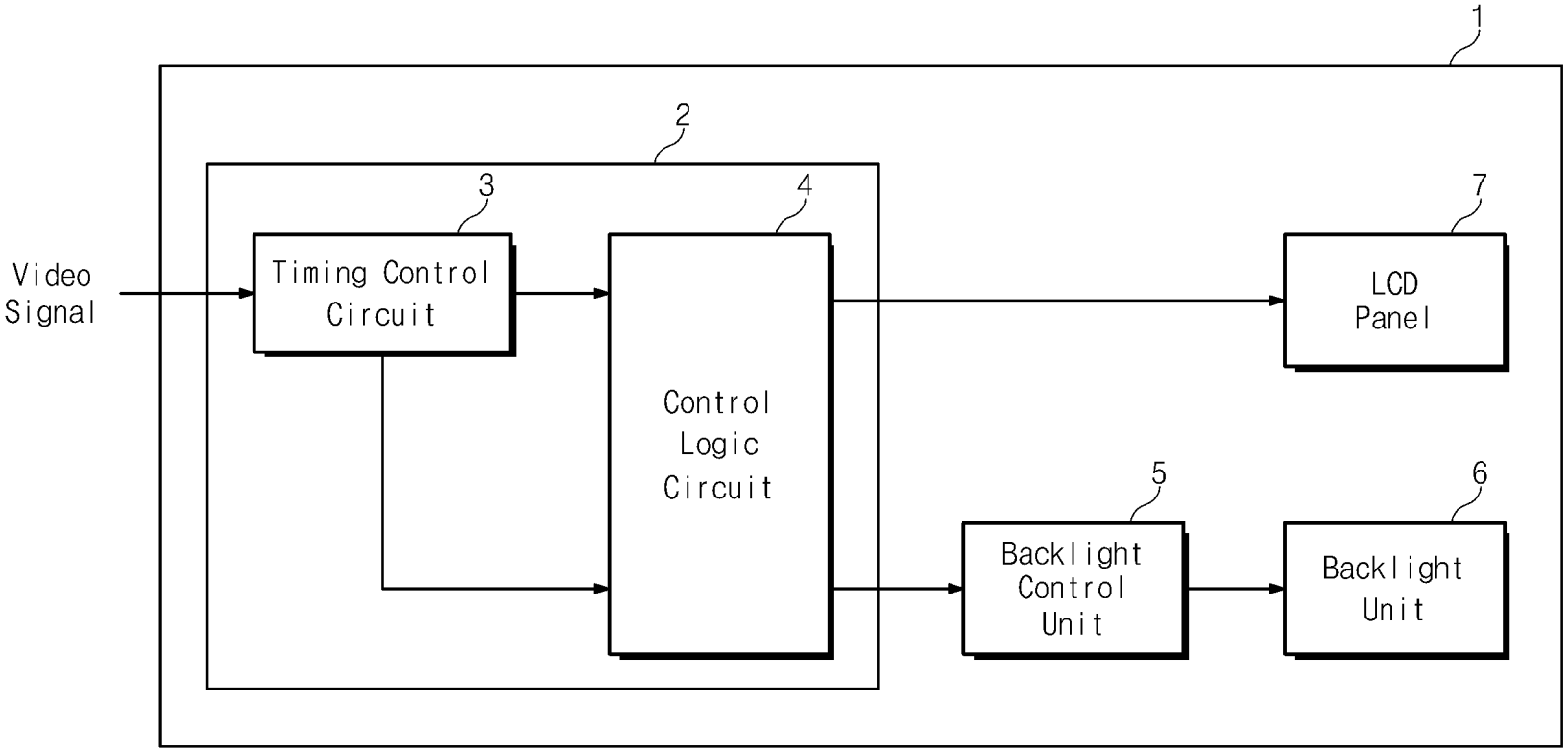
Fig. 1 (PRIOR ART)
FIG. 1 is a block diagram of a liquid crystal display of the prior art.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings. It will be noted that the present invention is not limited to the exemplary embodiments described herein.

A liquid crystal display ("LCD") which includes a backlight control circuit according to an exemplary embodiment of the present invention will now be described in further detail with reference to the accompanying drawings.

Figure 5:
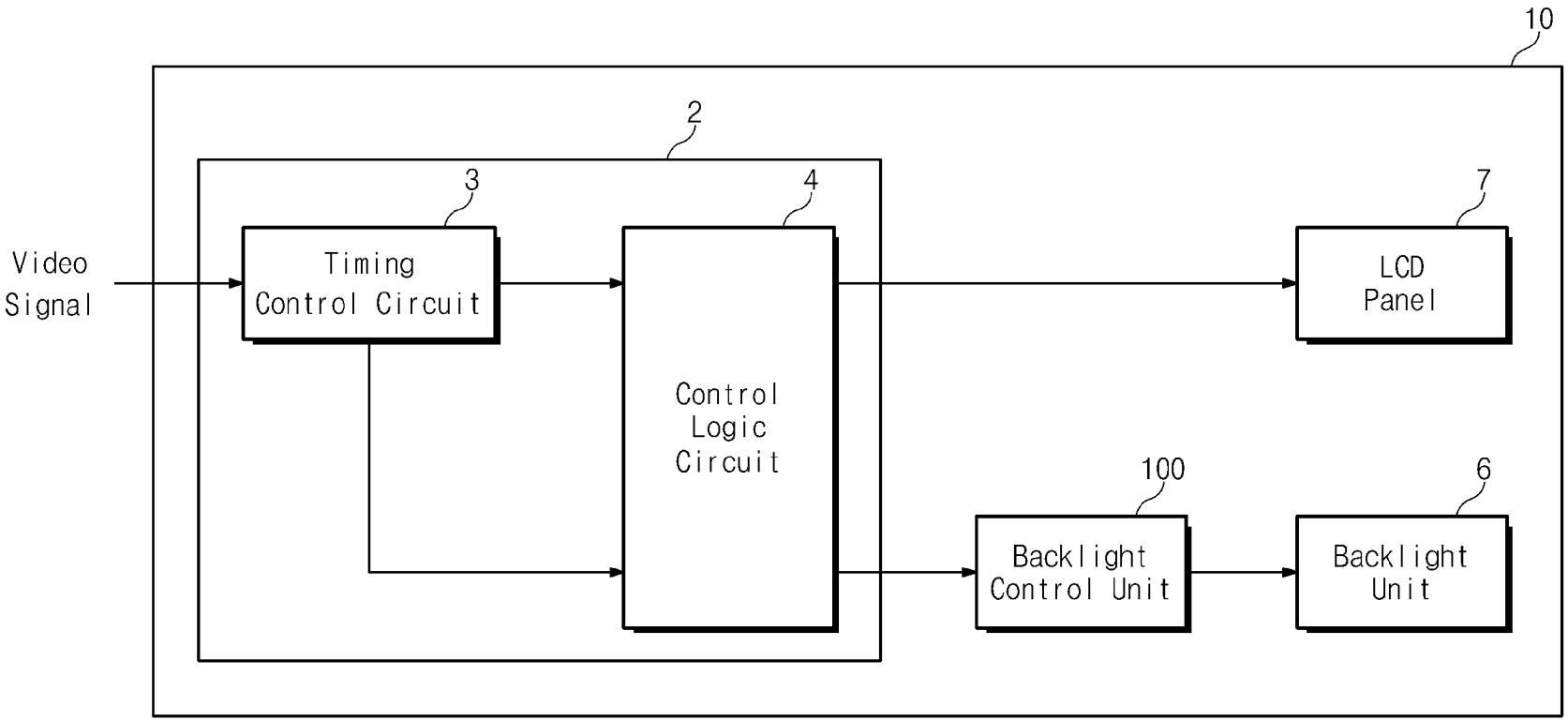
FIG. 5 is a block diagram of a liquid crystal display according to an exemplary embodiment of the present invention.

FIG. 5 is a block diagram of a liquid crystal display including a backlight control circuit according to an exemplary embodiment of the present invention.

Referring to FIG. 5, a liquid crystal display 10 includes a controller 2 which receives a video signal and includes a timing control circuit 3 and a control logic circuit 4, a backlight control unit 100, a backlight unit 6 and an LCD panel 7.

Figure 6:
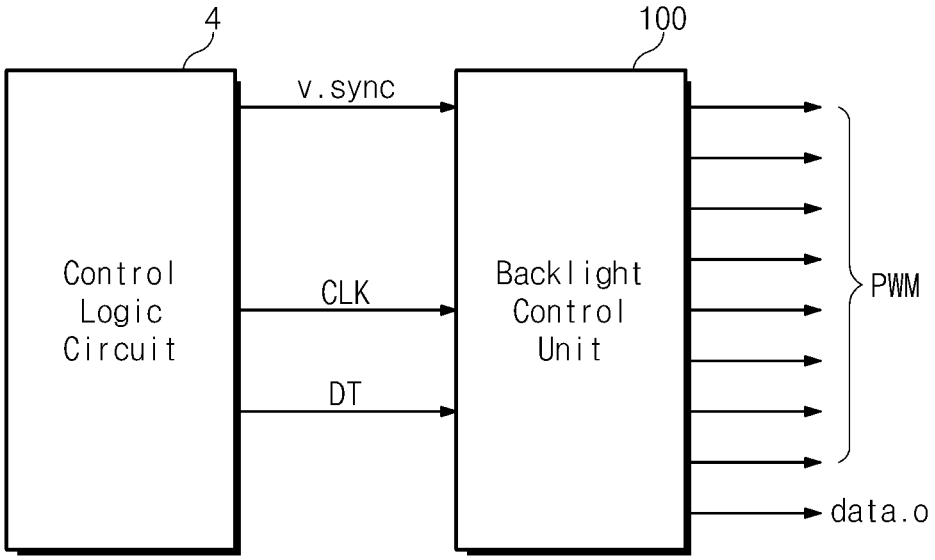
FIG. 6 is a block diagram which illustrates connections between the control logic circuit and the backlight control unit according to the exemplary embodiment of the present invention shown in FIG. 5.

FIG. 6 is a block diagram which illustrates connections between the control logic circuit 4 and the backlight control unit 100 according to the exemplary embodiment of the present invention shown in FIG. 5.

Referring to FIG. 6, the control logic circuit 4 is connected to the backlight control unit 100 through three external interconnections to serially transmit a vertical synchronization signal v.sync, a serial transmission clock signal CLK and digital video data DT. In addition, the backlight control unit 100 includes a plurality of backlight control circuits 100*a* to 100*j* (FIGS. 7 and 8, described in greater detail below).

Figure 7:
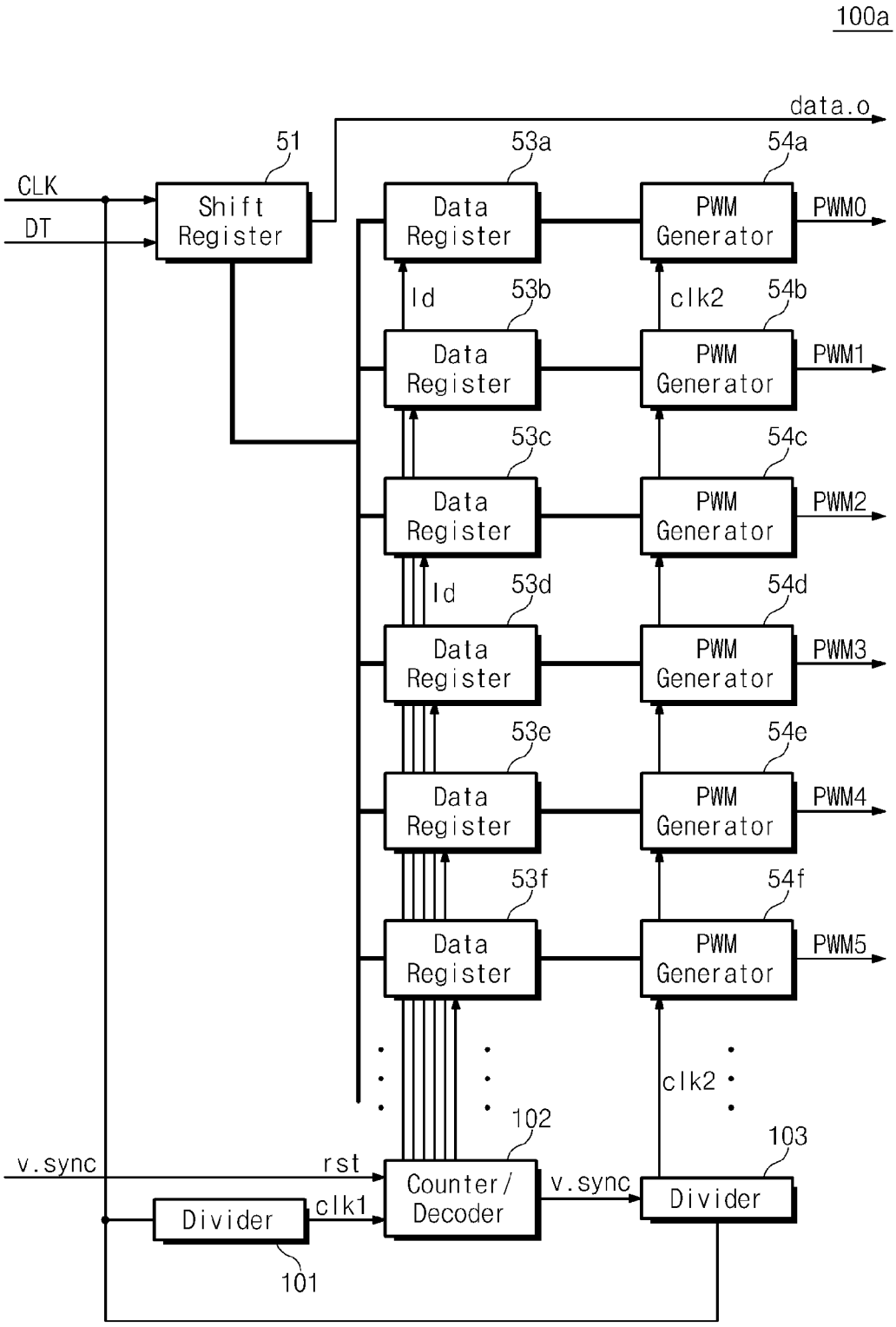
FIG. 7 is a block diagram of a backlight control circuit according to an exemplary embodiment of the present invention.

FIG. 7 is a block diagram of a backlight control circuit 100*a* according to an exemplary embodiment of the present invention.

Figure 8:
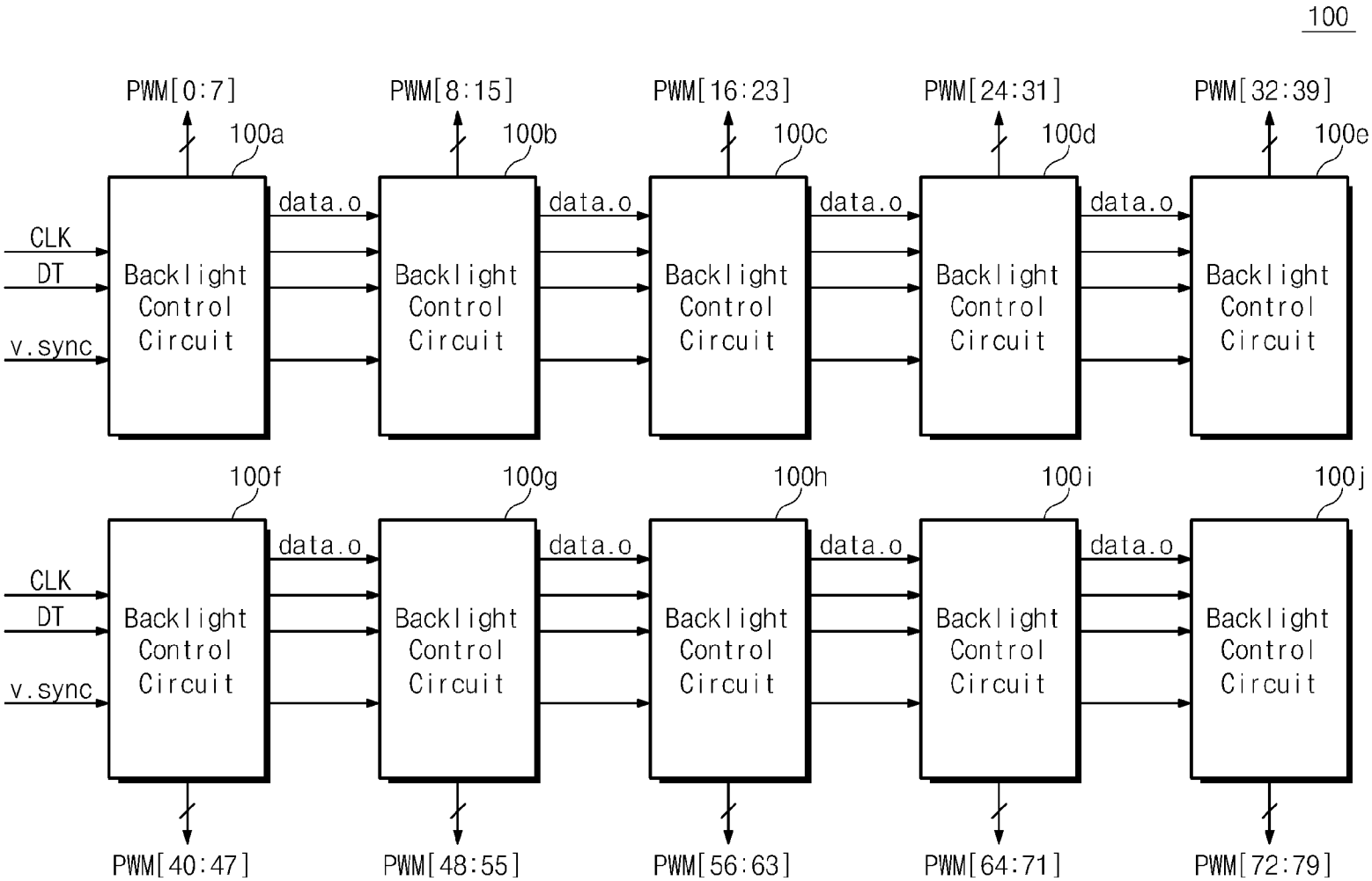
FIG. 8 is a block diagram of a backlight control unit according to an exemplary embodiment of the present invention.
Figure 10:
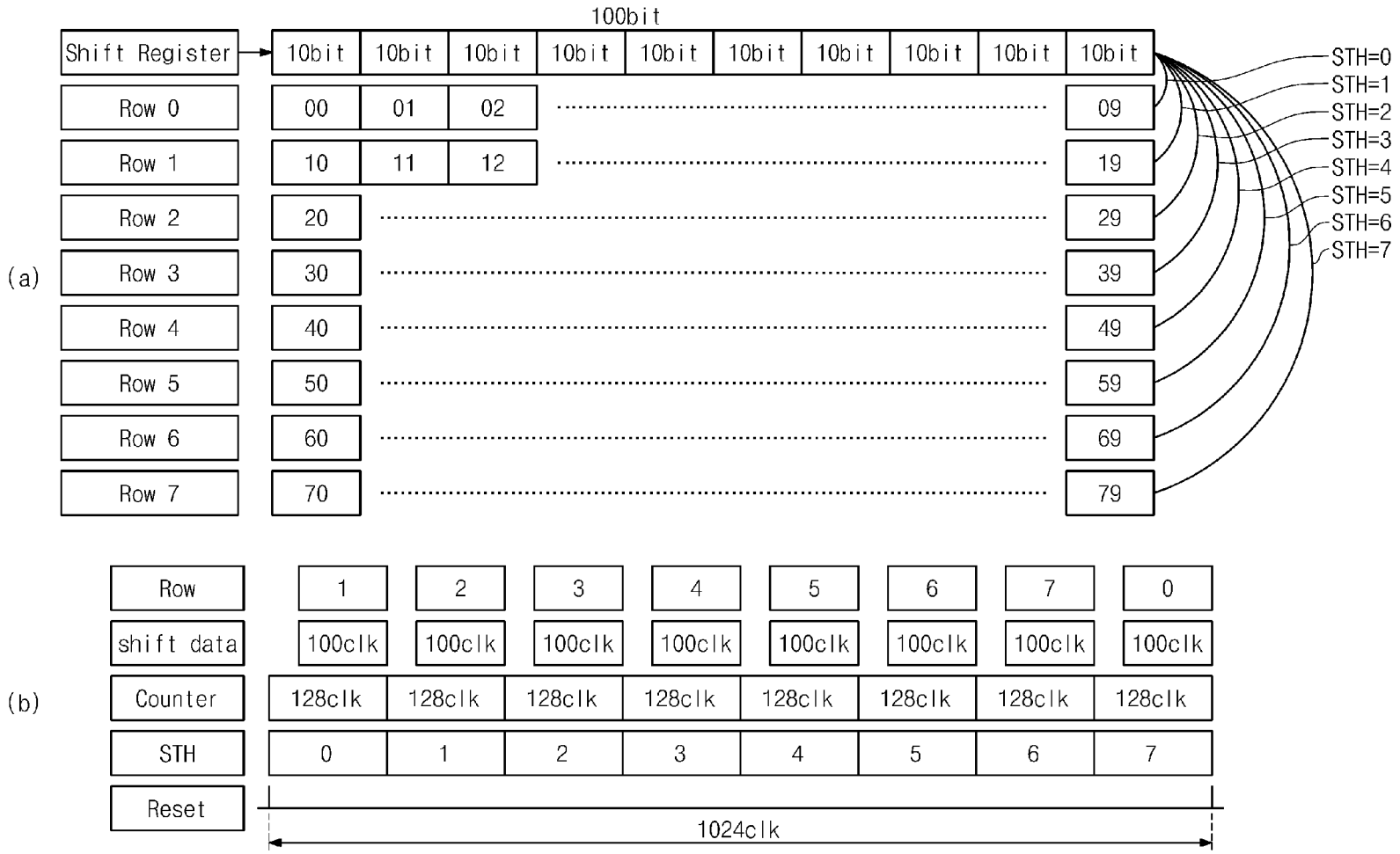
FIG. 10*a* is a block diagram which shows a state in which backlight control circuits according to an exemplary embodiment of the present invention transmit 10-bit digital video data corresponding to one frame.
FIG. 10*b* is a block diagram which shows a state in which backlight control circuits according to an alternative exemplary embodiment of the present invention transmit 100-bit digital video data corresponding to one frame.

Referring to FIG. 7, the backlight control circuit 100*a* includes a shift register 51, data registers 53*a* to 53*f*, pulse width modulation ("PWM") generators 54*a* to 54*f*, a first divider 101, a second divider 103 and a counter/decoder 102. In an exemplary embodiment of the present invention, the PWM generators 54*a* to 54*f* are control signal generators, e.g., control signal generators 54*a* to 54*f*. The shift register 51 stores video data DT transmitted from the control logic circuit 4 based on a frequency of the serial transmission clock signal CLK provided from the control logic circuit 4. In an exemplary embodiment of the present invention, the video data DT is a 10-bit digital video data signal DT. As shown in FIG. 8, the shift register 51 generates an internal load pulse signal data.o. In an exemplary embodiment, the internal load pulse signal data.o is a horizontal start signal STH, as shown in FIG. 10 and described in greater detail below, which enables the backlight control circuits 100*a* to 100*j* to begin serially transmitting the digital video data DT. The internal load pulse signal data.o is input to a subsequent adjacent backlight control circuit, e.g., the backlight control circuit 100*b* provided in a next, e.g., subsequent adjacent stage, as shown in FIG. 8. In the backlight control circuits 100*b* and 100*f*, the internal load pulse signal data.o is generated from the shift register 51, illustrated in FIG. 8. Further, in the backlight control circuits 100*b* to 100*e* and 100*g* to 100*j*, the internal load pulse signal data.o is provided from an adjacent previous stage, as also illustrated in FIG. 8.

Referring again to FIG. 7, the first divider 101 divides the serial transmission clock signal CLK received from the control logic circuit 4 (FIG. 6) to generate a first clock signal clk1.

The second divider 103 divides the serial transmission clock signal CLK, provided from the control logic circuit 4, to generate a second clock signal clk2.

The counter/decoder 102 counts a number of pulses of the first clock clk1, input to the counter/decoder 102 from the divider 101, and decodes a count value based on the number of pulses counted by the counter/decoder 102. The counter/decoder 102 generates a decoding signal id used to set output timing of the digital video data DT transmitted from the data registers 53*a* to 53*f* by using the count value decoded by the, e.g., a decoded count value, and transmits the decoding signal 1*d* to the data registers 53*a* to 53*f*. In addition, the counter/decoder 102 receives the vertical synchronization signal v.sync input from the control logic circuit 4 (FIG. 6), as a reset pulse rst, to initialize the count value decoded by the counter/decoder 102.

Thus, the data registers 53*a* to 53*f* receive and store the digital video data DT, e.g., the 10-bit digital video data signal DT, loaded into the shift register 51, in response to the decoding signal 1*d* transmitted from the counter/decoder 102.

Still referring to FIG. 7, the PWM generators 54*a* to 54*f* receive the 10-bit digital video data signal DT stored in the data registers 53*a* to 53*f*, and generate PWM pulse signals PWM0 to PWM5 corresponding to the 10-bit digital video data signal DT in response to the second clock signal clk2. In an exemplary embodiment of the present invention, the PWM pulse signals PWM0 to PWM5 are brightness control signals.

Figure 3:
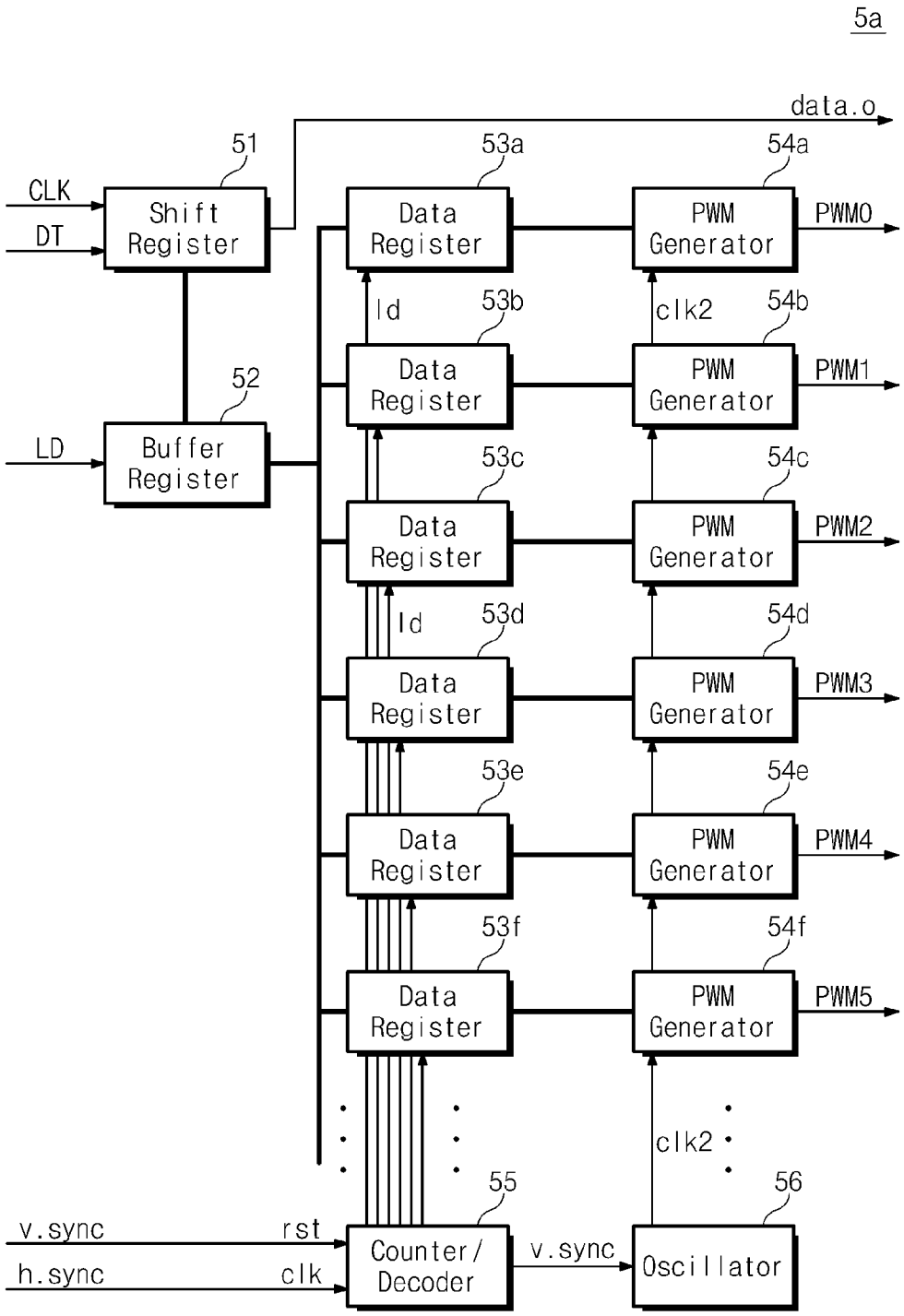
Fig. 3 (PRIOR ART)
FIG. 3 is a block diagram of an internal structure of a backlight control circuit of the prior art.
Figure 4:
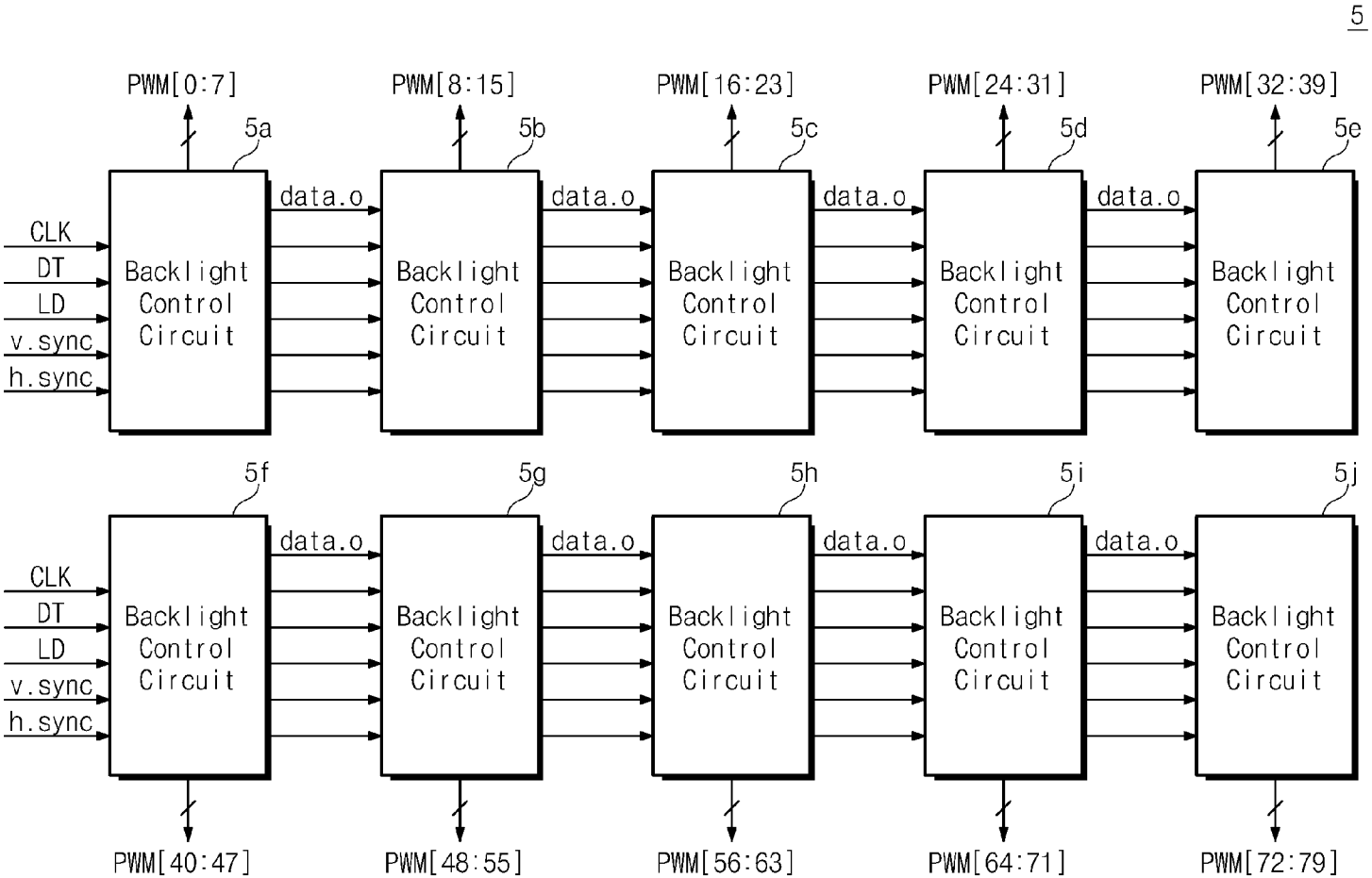
Fig. 4 (PRIOR ART)
FIG. 4 is a block diagram of an internal structure of a backlight control unit of the prior art.

Thus, the backlight control circuit 100*a* according to an exemplary embodiment of the present invention includes the first divider 101 which divides the serial transmission clock signal CLK to generate the first clock signal clk1 for the decoding signal 1*d*, and the second divider 103 which divides the serial transmission clock signal CLK to generate the second clock signal clk2 for the PWM pulse signals PWM0 to PWM5. Accordingly, and in contrast to the backlight control circuit 5*a* of the prior art as described above and shown in FIG. 3, the oscillator 56 is not required in the backlight control circuit 100*a* according to exemplary embodiments of the present invention. In addition, a PLL circuit used to correct an asynchronization problem between timings which control a display of a video and a timing which controls a brightness of the backlight unit are not required in exemplary embodiments of the present invention. Further, the first divider 101 and the second divider 103 divide a same serial transmission clock signal CLK to generate the first clock signal clk1 and the second clock signal clk2, and a degradation of a quality of a video displayed on the LCD panel 7 (caused in the prior art by the asynchronization problem between the reference clock signal clk and the vertical synchronization signal v.sync) is substantially reduced and/or effectively prevented in exemplary embodiments of the present invention.

FIG. 7 shows the backlight control circuit 100*a* including the six data registers 53*a* to 53*f* and the six PWM generators 54*a* to 54*f*, in which the six PWM generators 54*a* to 54*f* output the PWM pulse signals PWM0 to PWM5. However, alternative exemplary embodiments of the present invention are not limited thereto. Rather, each of the backlight control circuits 100*a* to 100*j*, shown in FIG. 8 and which will be described in further detail later, may output eight PWM pulse signals, e.g., PWM signals PWM0 to PWM7, in an alternative exemplary embodiment of the present invention. In this case, the backlight control circuit 100*a* shown in FIG. 7 includes eight data registers, e.g., data registers 53*a* to 53*h*, as well as eight PWM generators, e.g., PWM generators 54*a* to 54*h*. In other words, the backlight control circuit 100*a* shown in FIG. 7 according to an alternative exemplary embodiment further includes two additional data registers and two additional PWM generators. However, since the two additional data registers and the two additional PWM generators are configured and operate substantially the same as described herein with reference to FIG. 7, repetitive detailed description thereof will herein be omitted.

FIG. 8 is a block diagram of a backlight control unit according to an exemplary embodiment of the present invention including the backlight control circuit 100*a* shown in FIG. 7.

Referring to FIG. 8, the backlight control unit 100 includes a plurality of backlight control circuits 100*a* to 100*j*. Backlight control circuits 100*b* to 100*j* of the plurality of backlight control circuits 100*a* to 100*j* have substantially the same structure as a structure of the backlight control circuit 100*a* described in greater detail above with reference to FIG. 7. In an exemplary embodiment of the present invention, the backlight control unit 100 controls a brightness of local blocks of light sources, such as 10×8 local blocks, e.g., 10 blocks each including 8 light sources, by classifying the light sources provided inside the backlight unit 6 into the 10×8 local blocks.

To this end, the backlight control circuits 100*a* to 100*j* provided in the backlight control unit 100 each have eight output lines to output PWM pulse signals to a corresponding block of 8 light sources. The backlight control circuits 100*a* to 100*j* are connected to each other through three signal lines which transmit three signals, e.g., the serial transmission clock signal clock, the digital video data DT, and the vertical synchronization signal v.sync. Thus, the backlight control unit 100 includes 10 backlight control circuits, e.g., the backlight control circuits 100*a* to 100*j* which control a turn-on/turn-off operation of light sources associated therewith and which are provided in the backlight unit 6 and further divided into the 10×8 local blocks. As a result, the backlight control unit 100 performs a local dimming control to control a brightness of each of the 10×8 local blocks.

As shown in FIG. 8, the eight PWM pulse signals output from each of the backlight control circuits 100*a* to 100*j* include PWM pulse signals PWM[0:7], PWM[8:15], PWM [16:23], PWM[24:31], PWM[32:39], PWM[40:47], PWM [48:55], PWM[56:63], PWM[64:71] and PWM[72:79]. Accordingly, the backlight control circuits 100*a* to 100*j* output, for each group of the ten PWM signals, eight PWM pulse signals in a row direction (with respect to a plurality of light sources provided inside the backlight unit 6), thereby controlling the brightness of each of the 10×8 local blocks.

Figure 9:
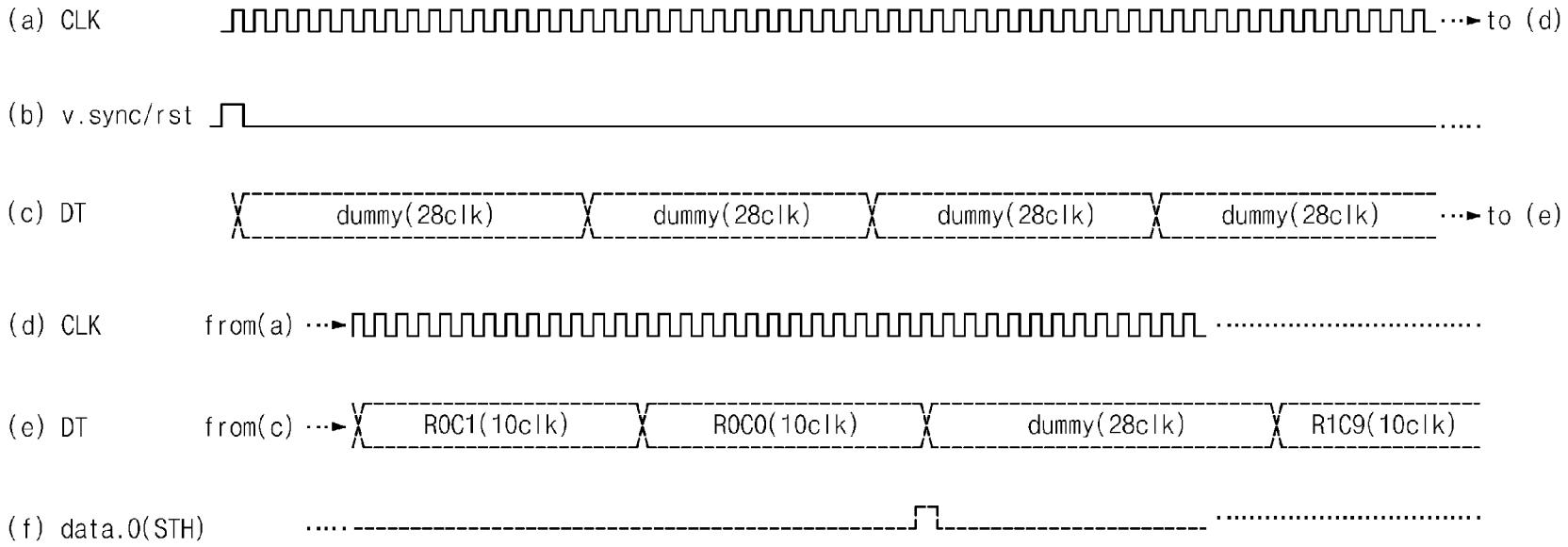
FIG. 9*a* to FIG. 9*f* are waveform timing diagrams of signals of a backlight control unit according to an exemplary embodiment of the present invention.

Hereinafter, an operation of the backlight control unit 100 will be described in further detail with reference to FIGS. 9 and 10.

FIG. 9*a* to FIG. 9*f* are waveform timing diagrams of signals of a backlight control unit according to an exemplary embodiment of the present invention.

Specifically, FIGS. 9*a* and 9*d* show waveforms of the serial transmission clock signal CLK, FIG. 9*b* shows the vertical synchronization signal v.sync/reset signal rest, FIGS. 9*c* and 9*e* show waveforms of the digital video data DT, and FIG. 9*f* shows a waveform of the internal load pulse signal data.o, e.g., the horizontal start signal STH.

FIG. 10*a* is a block diagram which shows a state in which the backlight control circuits 100*a* to 100*j* according to an exemplary embodiment of the present invention transmit 10-bit digital video data DT corresponding to one frame, and FIG. 10*b* is a block diagram which shows a state in which the backlight control circuits 100*a* to 100*j* according to an alternative exemplary embodiment of the present invention transmit 100-bit digital video data DT corresponding to one frame. In addition, FIGS. 9*a* to 9*f*, 10*a* and 10*b* illustrate an operation of the backlight control unit 100 according to an exemplary embodiment of the present invention when a brightness of a plurality of light sources provided inside the backlight unit 6 (not shown) is controlled according to 10×8 local blocks of light sources of the plurality of light sources. As described above in greater detail, the backlight control circuits 100*a* to 100*j* include the eight data registers 53*a* to 53*h* and the eight PWM generators 54*a* to 54*h* (see FIG. 7 and the accompanying description thereof).

In addition, when serially transmitting ten 10-bit digital video data signals DT in a given frame, e.g., one frame, the backlight control circuits 100*a* to 100*j* transmit the ten 10-bit digital video data signals DT using the serial transmission clock signal CLK having 128 pulses, e.g., clocks, (hereinafter represented as "128clk"). To this end, as shown in FIGS. 9*c* and 9*e*, before the ten 10-bit digital video data signals DT are serially transmitted, 28-bit dummy data dummy (28clk) are transmitted.

The backlight control unit 100 receives the serial transmission clock signal CLK, the vertical synchronization signal v.sync, e.g., the reset signal rst, shown in FIG. 9*a* to 9*c*, while serially receiving 28-bit dummy data and then ten 10-bit digital video data signals DT from the control logic circuit 4. In an exemplary embodiment of the present invention, the 28-bit dummy data and the ten 10-bit digital video data signals DT may each be serial transmission data corresponding to one frame of a video signal.

The backlight control circuits 100*a* to 100*j* sequentially store the ten 10-bit digital video data signals DT together with the dummy data in the shift register 51 at a predetermined timing interval based on the serial transmission clock signal CLK. Specifically, FIGS. 9*c* and 9*e* show a case in which the 28-bit dummy data dummy (28clk) corresponding to 28 clocks ("28clk") and ten 10-bit digital video data signals R0C9 to R0C0 (not all shown in FIG. 9*e*), each of which corresponds to 10 clocks ("10clk"), are processed.

The backlight control circuits 100*a* to 100*j* generate the first clock signal clk1 using the first divider 101 therein, while generating the second clock signal clk2 using the second divider 103 provided therein. The number of clocks, e.g., 10clk of the first clock signal clk1 is counted by the counter/decoder 102, and the decoding signal 1*d* is thereby obtained by decoding a count value, based on the counted number of clocks of the first clock signal, and is the decoding signal 1*d* is transmitted to the data registers 53*a* to 53*f* (best shown in FIG. 7). In addition, the shift register 51 provided in each of the backlight control circuits 100*a* to 100*j* outputs the internal load pulse signal data.o (e.g., the horizontal start signal STH) shown in FIG. 9*f* in 128clk units. In an exemplary embodiment of the present invention, 128clk units is a number of clocks corresponding to one frame.

The data registers 53*a* to 53*h* provided in each of the backlight control circuits 100*a* to 100*j* sequentially receive and store the ten 10-bit digital video data signals DT previously stored in the shift register 51, based on the decoding signal 1*d* supplied from the counter/decoder 102.

Thereafter, the PWM generators 54*a* to 54*h* of each of the backlight control circuits 100*a* to 100*j* receive the 10-bit digital video data signals DT, sequentially stored in the data registers 53*a* to 53*h*, and sequentially generate PWM pulse signals corresponding to the 10-bit digital video data signals DT based on the second clock signal clk2 transmitted from the second divider 103. In other words, as shown in FIG. 8 and described above in greater detail, the backlight control circuits 100*a* to 100*j* output eight PWM pulse signals PWM [0:7], PWM [8:15], PWM [16:23], PWM [24:31], PWM [32:39], PWM [40:47], PWM [48:55], PWM [56:63], PWM [64:71] and PWM [72:79], respectively.

Hereinafter, an operational procedure of the backlight control unit 100 will be described in further detail with reference to the timing charts shown in FIGS. 10*a* and 10*b*.

Referring to FIG. 10*a*, the shift register 51 of each of the backlight control circuits 100*a* to 100*j* stores the ten 10-bit digital video data signals DT corresponding to a one frame of a video signal. In addition, the backlight control circuits 100*a* to 100*j* sequentially store the 10-bit digital video data signals DT (e.g., 10-bit digital video data signal DT 00 to 10-bit digital video data signal DT 79), in parallel and in a direction from Row0 to Row7, as shown in FIG. 10*a*, and generate the PWM pulse signals (FIG. 8) of the corresponding 10-bit digital video data signals DT, through operation of the data registers 53*a* to 53*h* and the PWM generators 54*a* to 54*h* (FIG. 7) which were described in greater detail above with reference to FIGS. 9*a* to 9*f*.

The backlight control circuits 100*a* to 100*j* output the internal load pulse signal data.o (e.g., horizontal start signals STH=0 to STH=7) which correspond to a termination of a local dimming control for the 100-bit digital video data shown in FIG. 10*a*, e.g., for a one-frame video signal such as a one-frame digital video signal DT. Processing of the one-frame digital video data DT based on the internal load pulse signal data.o (e.g., the horizontal start signals STH=0 to STH=7) is shown in FIG. 10B.

Thus, the backlight control unit 100 according to an exemplary embodiment of the present invention generates PWM pulse signals corresponding to a one-frame video signal. In addition, when the one-frame video signal is displayed, the backlight control unit 100 divides a plurality of light sources provided in the backlight unit 6 into 10×8 local blocks to control a brightness corresponding to each block.

Further, the backlight control circuits 100*a* to 100*j* of the backlight control unit 100 of the liquid crystal display 10 according to an alternative exemplary embodiment of the present invention include the first divider 101 (FIG. 7) which divides the serial transmission clock signal CLK to generate the first clock signal clk1 for the decoding signal 1*d*, and the second divider 103 which divides the serial transmission clock signal CLK to generate the second clock signal clk2 for the PWM pulse signals. Accordingly, and in contrast to the backlight control circuit 5*a* of the prior art shown in FIG. 3, the oscillator 56 thereof is not required in an exemplary embodiment of the present invention. As a result, a PLL circuit which corrects a synchronization time difference is also not required in an exemplary embodiment of the present invention. Therefore, a number of circuit components of the backlight control unit 100 is substantially reduced, and a design and/or manufacturing cost for the backlight control unit 100 is substantially reduced and/or effectively minimized.

In addition, since the first divider 101 and the second divider 103 according to an exemplary embodiment divide a same serial transmission clock signal CLK to generate both the first clock signal clk1 and the second clock signal clk2, a synchronization time difference is effectively prevented when a digital video signal data is transmitted.

Figure 2:
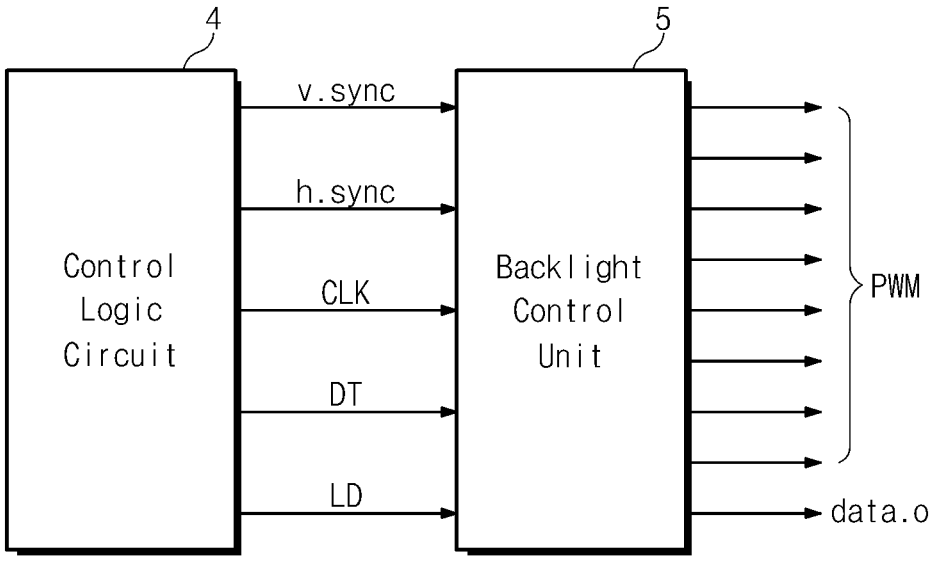
Fig. 2 (PRIOR ART)
FIG. 2 is a block diagram which illustrates connections between a control logic circuit of the prior art and a backlight control unit of the prior art.

Further, in the backlight control unit 100 of the liquid crystal display 10 according to an exemplary embodiment of the present invention, serially transmitted signals inside and/or outside the backlight control unit 100, e.g., serially transmitted signals which control a local dimming operation include only the vertical synchronization signal v.sync, the serial transmission clock signal CLK and the digital video data DT. Accordingly, a number of external interconnections connected to the inside and/or the outside of the backlight control unit 100 according to an exemplary embodiment is reduced, e.g., to three (3) (from five (5), as required in the backlight control unit of the prior art shown in FIG. 2).

Hereinafter, a liquid crystal display including the backlight control unit 100 according to the exemplary embodiment of the present invention shown in FIG. 8 will be described in further detail with reference to FIG. 11.

Figure 11:
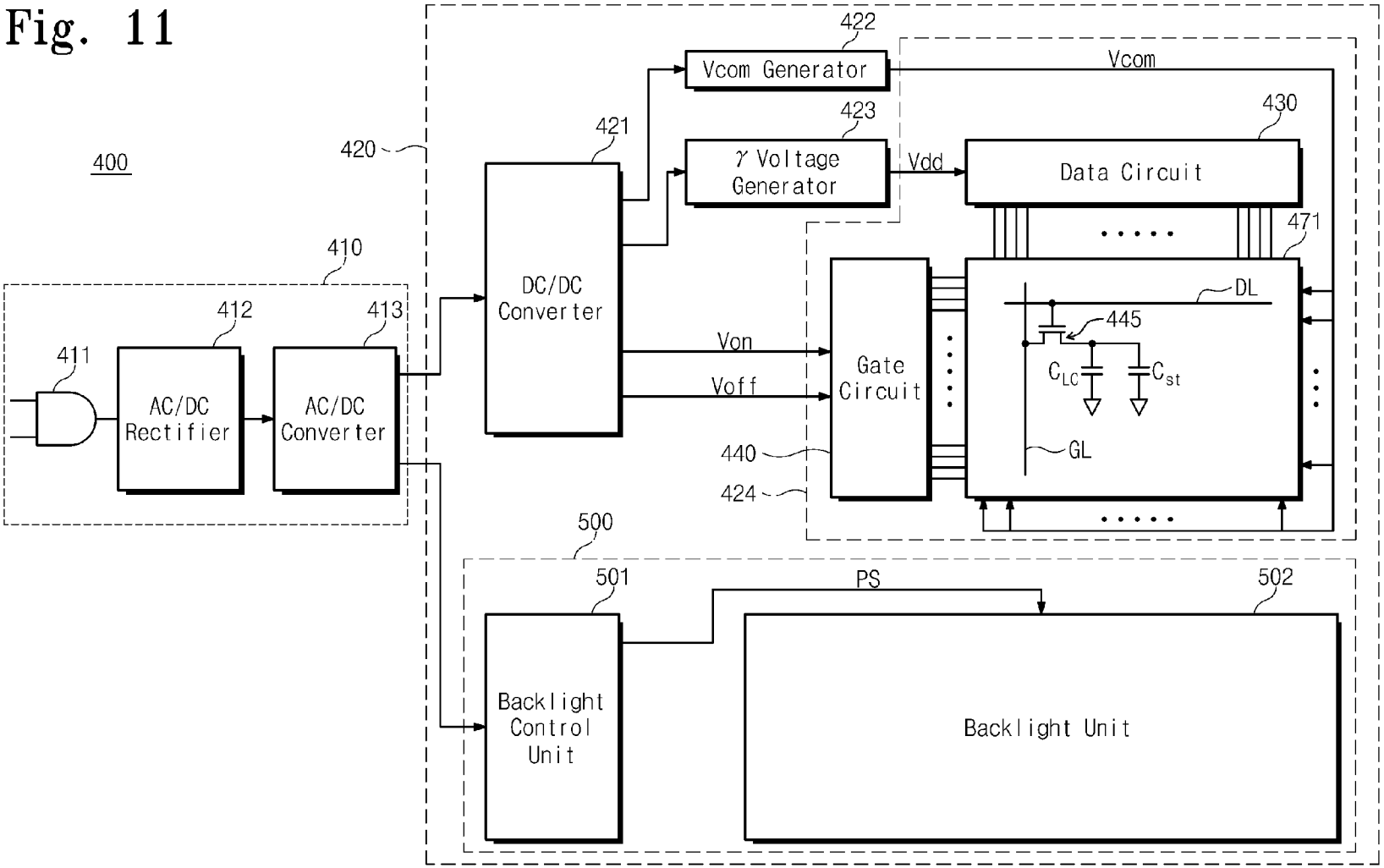
FIG. 11 is a block diagram of a liquid crystal display according to an exemplary embodiment of the present invention.

FIG. 11 is a block diagram of a liquid crystal display according to an exemplary embodiment of the present invention.

Referring to FIG. 11, a liquid crystal display 400 according to an exemplary embodiment of the present invention includes an alternating current/direct current ("AC/DC") power supply 410, and an LCD module 420 including a backlight device 500 having a backlight control unit 501 and a backlight unit 502.

The AC/DC power supply 410 includes a plug 411, an AC/DC rectifier 412, and an AC/DC converter 413. In an exemplary embodiment, the AC/DC power supply 410 converts an external common supply voltage, e.g., of approximately 100V, approximately 120V or, alternatively, approximately 240V, into a DC supply voltage and outputs the DC supply voltage to the LCD module 420.

The LCD module 420 includes a DC/DC converter 421, a common electrode voltage generator ("Vcom generator") 422, a gamma ("γ") voltage generator 423, an LCD panel 424, and the backlight device 500 to display a video in response to video data input from an external graphic controller (not shown).

The common electrode voltage generator 422 generates a common electrode voltage Vcom based on a DC voltage, level-changed by the DC/DC converter 421, and outputs the common electrode voltage Vcom to the LCD panel 424.

The DC/DC converter 421 supplies a gate circuit 440 with a gate-on voltage Von and a gate-off voltage Voff. The gate circuit 440 supplies the gave-on voltage Von and the gate-off voltage Voff to a gate line GL of a liquid crystal panel 471.

The gamma ("γ") voltage generator 423 generates a γ voltage Vdd based on the DC voltage, level-shifted by the DC-DC converter 421, and supplies the γ voltage Vdd to a data line DL of the LCD panel 424 via a data circuit 430.

A switching element 445, e.g., a TFT 445, is connected to the data line DL and the gate line GL, and a data voltage, based on the γ voltage Vdd, is supplied to a liquid crystal capacitor Clc and a storage capacitor Cst of the liquid crystal panel 471 via the TFT 445.

Although the common electrode voltage generator 422 and the gamma ("γ") voltage generator 423 are separate from the LCD panel 424 as shown in FIG. 11, alternative exemplary embodiments are not limited thereto. Rather, the common electrode voltage generator 422 and/or the gamma ("γ") voltage generator 423 may be provided in the LCD panel 424.

The backlight device 500 includes the backlight control unit 501 and the backlight unit 502. The backlight control unit 501 includes the backlight control circuits 100*a* to 100*j* described above in greater detail and shown in FIG. 8. The backlight unit 502 includes a plurality of light sources such as a plurality of LEDs.

Thus, the liquid crystal display 400 according to an exemplary embodiment of the present invention includes the backlight control unit 501 having the backlight control circuits 100*a* to 100*j*. As described in greater detail above, the backlight control circuits 100*a* to 100*j* each include the shift register 51, the data registers 53*a* to 53*h*, the PWM generators 54*a* to 54*h*, the first divider 101 and the second divider 103, and the counter/decoder 102 to output PWM pulse signals PS to the backlight unit 502.

Accordingly, the liquid crystal display 400 controls a brightness of the plurality of light sources of the backlight unit 502 by controlling a brightness of each local block thereof.

In an alternative exemplary embodiment of the present invention, the AC/DC power supply 410 may be provided in the LCD module 420.

Figure 12:
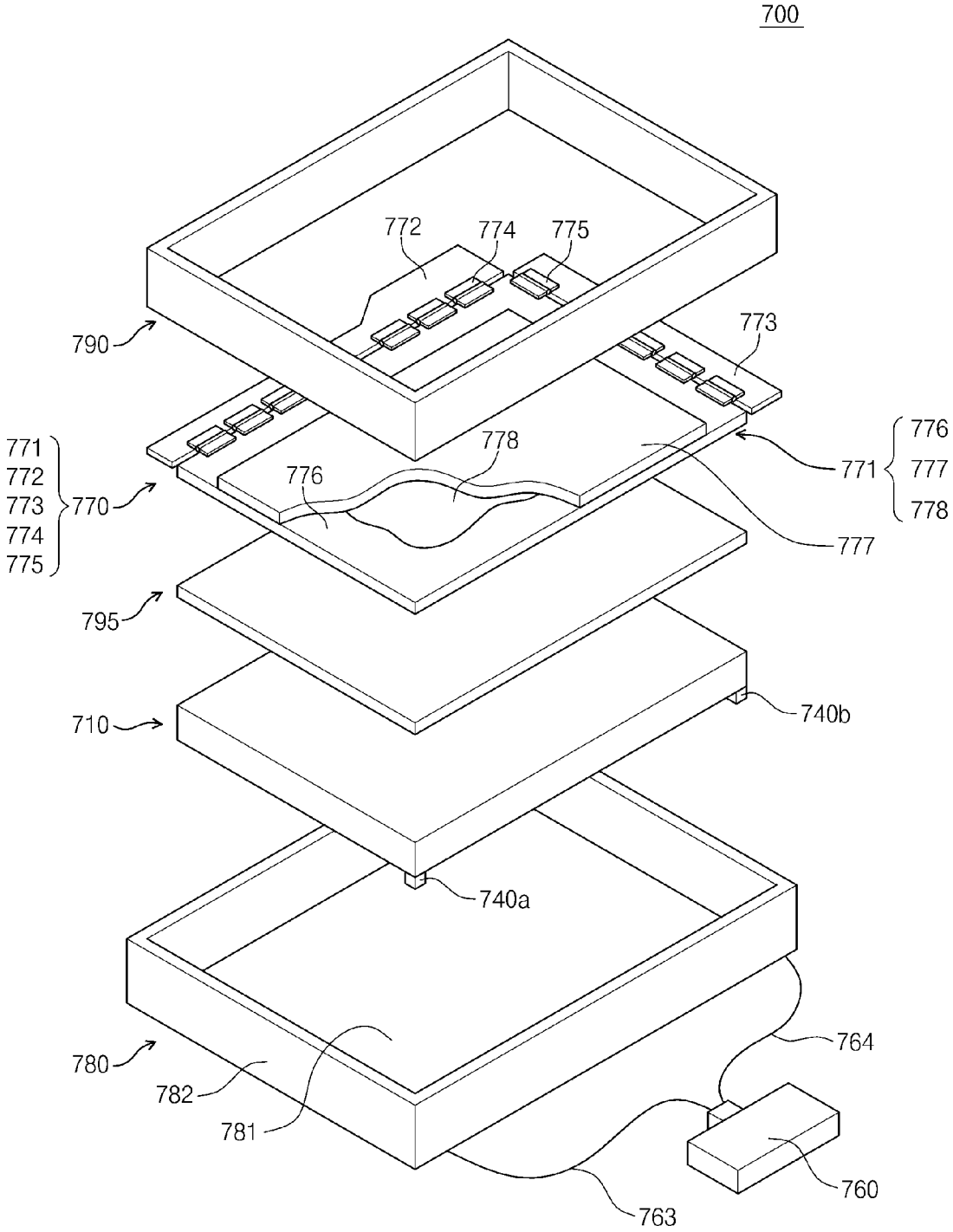
FIG. 12 is an exploded perspective view of a liquid crystal display according to an exemplary embodiment of the present invention.

FIG. 12 is an exploded perspective view of a liquid crystal display according to an exemplary embodiment of the present invention.

Referring now to FIG. 12, a liquid crystal display 700 according to an exemplary embodiment of the present invention includes a backlight assembly 710, a display unit 770 and a container 780. The backlight assembly 710 includes a plurality of light sources such as a plurality of LEDs (not shown).

The display unit 770 includes a liquid crystal panel 771 which displays a video, and a data circuit 772 and a gate circuit 773 which output a driving signal used to drive the liquid crystal panel 771. The data circuit 772 and the gate circuit 773 are electrically connected to the liquid crystal panel 771 through a data tape carrier package ("TCP") 774 and a gate TCP 775, respectively.

The liquid crystal panel 771 includes a thin film transistor (TFT) substrate 776, a color filter substrate 777 coupled to the TFT substrate 776 and disposed opposite to, e.g., facing, the TFT substrate 776, and a liquid crystal layer 778 interposed between the TFT substrate 776 and the color filter substrate 777.

In an exemplary embodiment of the present invention, the TFT substrate 776 may be a transparent glass substrate formed with the TFT 445, e.g., the switching element 445 (FIG. 11). The TFT 445 includes source and gate terminals connected to data lines D1 and gate lines GL (FIG. 11), respectively. The TFT has a drain terminal formed with a common electrode (not shown) including a conductive material.

The color filter substrate 777 has pixels formed through a thin film process. In an exemplary embodiment of the present invention, the pixels include red ("R"), green ("G") and blue ("B") pixels. The color filter substrate 777 includes the common electrode (not shown) including a conductive material.

The container 780 includes a bottom surface 781 and a sidewall 782 extending substantially perpendicularly from a peripheral edge portion of the bottom surface 781 such that the container 780 forms a receiving space. The backlight assembly 710 and the liquid crystal panel 771 are received in the receiving space.

A size of the bottom surface 781 is sufficient to accommodate the backlight assembly 710. In an exemplary embodiment, the bottom surface 781 and the backlight assembly 710 have a substantially rectangular shape, e.g. a plate shape. The sidewall 782 extends from the peripheral edge of the bottom surface 781, substantially perpendicular to the bottom surface 781, such that the backlight assembly 781 is prevented from separating from the container 780.

According to an exemplary embodiment of the present invention, the liquid crystal display 700 further includes a backlight control unit 760 and a top chassis 790.

The backlight control unit 760 according to an exemplary embodiment is provided outside the container 780, and generates the PWM pulse signals PS (best shown in FIG. 11) to drive the backlight assembly 710. The PWM pulse signals PS generated from the backlight control unit 760 are applied to the backlight assembly 710 through a first power line 763 and a second power line 764. The first power line 763 and the second power line 764 are connected to a first electrode 740*a* and a second electrode 740*b* formed at opposite ends of the backlight assembly 710. In a exemplary embodiment, the first power line 763 and the second power line 764 are directly connected to the first electrode 740*a* and the second electrode 740*b*, respectively, or, alternatively, the first power line 763 and the second power line 764 are indirectly connected to the first electrode 740*a* and the second electrode 740*b*, respectively, via another member (not shown). The backlight control circuits 100*a* to 100*j*, described in greater detail above, are included in the backlight control unit 760 according to an exemplary embodiment of the present invention.

The top chassis 790 is coupled to, e.g., is connected to, the container 780, while substantially surrounding at least a portion of peripheral edges of the liquid crystal display panel 771. The top chassis 790 effectively prevents the liquid crystal display panel 771 from being damaged due to an external shock, for example, and also effectively prevents the liquid crystal display panel 771 from being separated from the container 780.

The liquid crystal display 700 according to an exemplary embodiment further includes at least one optical sheet 795 to improve a characteristic of light projected from the backlight assembly 710. The optical sheet 795 may include, for example, a diffusion sheet to diffuse light or a prism sheet to collect light, but alternative exemplary embodiments are not limited thereto.

Although a liquid crystal display employing LEDs as a plurality of light sources has herein described, a liquid crystal display according to an alternative exemplary embodiment may employ other light sources which may be controlled by the PWM pulse signals PS (FIG. 11). Accordingly, the light sources for the liquid crystal display according to alternative exemplary embodiments of the present invention are not limited to LEDs.

According to exemplary embodiments of the present invention as described herein, in a backlight control circuit, a backlight device and a liquid crystal display having the backlight control circuit, a number of components and external interconnections connected to the backlight control circuit is effectively reduced in the backlight control circuit which controls a brightness of a plurality of light sources provided inside the backlight unit by controlling a brightness of each local block.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes and modifications in form and details may be made therein without departing from the spirit or scope of the present invention as defined by the following claims.

What is claimed is:

1. A backlight control circuit which controls a backlight unit including a plurality of light sources which emits light, the backlight control circuit comprising:

a shift register which receives and stores digital video data based on a transmission clock signal input to the shift register, the digital video data based on a video signal having a predetermined period;

a first divider which divides the transmission clock signal to generate a first clock signal;

a counter/decoder which initializes a count value based on a vertical synchronization signal, counts a number of pulses of the first clock signal, and outputs a decoding signal obtained by decoding the count value obtained by counting the number of the pulses of the first clock signal, wherein the decoding signal is used to set an output timing of the digital video data stored in the shift register;

a plurality of data registers which receives and stores the digital video data stored in the shift register based on the decoding signal;

a second divider which divides the transmission clock signal to generate a second clock signal; and a plurality of control signal generators which generates brightness control signals based on the second clock signal in response to the digital video data stored in the data registers to locally control a brightness of light sources of the plurality of light sources, wherein the transmission clock signal is directly applied to the first divider and the second divider.

2. The backlight control circuit of claim 1, wherein the shift register receives the digital video data corresponding to one frame to transmit the digital video data corresponding to the one frame to the plurality of data registers, the plurality of data registers divides and stores the digital video data corresponding to the one frame, and the plurality of control signal generators generates the brightness control signals based on the second clock signal in response to the digital video data stored in the plurality of data registers to locally control the brightness of blocks of the light sources.

3. The backlight control circuit of claim 2, wherein the brightness control signals comprise a pulse width modulation signal having a pulse shape and a pulse width controlled by the plurality of control signal generators.

4. The backlight control circuit of claim 2, further comprising a plurality of external interconnections which receive the transmission clock signal, the digital video data and the vertical synchronization signal.

5. A backlight device comprising:

a backlight unit including a plurality of light sources; and a plurality of backlight control circuits which locally control a brightness of blocks of light sources of the plurality of light sources, wherein the backlight control circuits of the plurality of backlight control circuits comprise:

a shift register which receives and stores digital video data based on a transmission clock signal input to the shift register, the digital video data based on a video signal having a predetermined period;

a first divider which divides the transmission clock signal to generate a first clock signal;

a counter/decoder which initializes a count value based on a vertical synchronization signal, counts a number of pulses of the first clock signal, and outputs a decoding signal obtained by decoding the count value obtained by counting the number of the pulses of the first clock signal, wherein the decoding signal is used to set an output timing of the digital video data stored in the shift register;

a plurality of data registers which receives and stores the digital video data stored in the shift register based on the decoding signal;

a second divider which divides the transmission clock signal to generate a second clock signal; and a plurality of control signal generators which generates brightness control signals based on the second clock signal in response to the digital video data stored in the data registers to locally control the brightness of the blocks of light sources, wherein the transmission clock signal is directly applied to the first divider and the second divider.

6. The backlight device of claim 5, wherein the backlight control circuits are connected to each other by external interconnections which transmit the transmission clock signal, the digital video data and the vertical synchronization signal.

7. A liquid crystal display comprising:

a backlight unit including a plurality of light sources which projects light;

a plurality of backlight control circuits which locally controls brightness of blocks of light sources of the plurality of light sources; and a liquid crystal display panel which displays a video with the light, wherein each of the backlight control circuits comprises:

a shift register which receives and stores digital video data based on a transmission clock signal input to the shift register, the digital video data based on a video signal having a predetermined period;

a first divider which divides the transmission clock signal to generate a first clock signal;

a counter/decoder which initializes a count value based on a vertical synchronization signal, counts a number of pulses of the first clock signal, and outputs a decoding signal obtained by decoding the count value obtained by counting the number of the pulses of the first clock signal, wherein the decoding signal is used to set an output timing of the digital video data stored in the shift register;

a plurality of data registers which receives and stores the digital video data stored in the shift register based on the decoding signal;

a second divider which divides the transmission clock signal to generate a second clock signal; and a plurality of control signal generators which generates brightness control signals based on the second clock signal in response to the digital video data stored in the data registers to locally control the brightness of the blocks of light sources, wherein the transmission clock signal is directly applied to the first divider and the second divider.

8. A liquid crystal display comprising:

a liquid crystal display panel which displays a video using light; and a backlight device which emits the light, wherein the backlight device comprises:

a backlight unit including a plurality of light sources;

a shift register which receives and stores digital video data based on a transmission clock signal input to the shift register, the digital video data based on a video signal having a predetermined period;

a first divider which divides the transmission clock signal to generate a first clock signal;

a counter/decoder which initializes a count value based on a vertical synchronization signal, counts a number of pulses of the first clock signal, and outputs a decoding signal obtained by decoding the count value obtained by counting the number of the pulses of the first clock signal, wherein the decoding signal is used to set an output timing of the digital video data stored in the shift register;

a plurality of data registers which receives and stores the digital video data stored in the shift register based on the decoding signal;

a second divider which divides the transmission clock signal to generate a second clock signal; and a plurality of control signal generators which generates brightness control signals based on the second clock signal in response to the digital video data stored in the data registers to locally control a brightness of blocks of light sources of the plurality of light sources, wherein the transmission clock signal is directly applied to the first divider and the second divider.

9. A liquid crystal display comprising:

a display unit comprising:

a liquid crystal display panel;

data circuits connected to the liquid crystal display panel; and gate circuits connected to the liquid crystal display panel;

a backlight unit comprising a plurality of light sources which emits light;

a backlight assembly;

a container which receives the backlight assembly;

a top chassis which surrounds a peripheral edge of the liquid crystal display panel and is connected to the container, to prevent the liquid crystal display panel from damage;

at least one optical sheet disposed between the liquid crystal display panel and the backlight assembly; and a backlight control circuit which controls the backlight unit, wherein the backlight control circuit comprises:

a shift register which receives and stores digital video data based on a transmission clock signal input to the shift register, the digital video data based on a video signal having a predetermined period;

a first divider which divides the transmission clock signal to generate a first clock signal;

a counter/decoder which initializes the count value based on a vertical synchronization signal, counts a number of pulses of the first clock signal, and outputs a decoding signal obtained by decoding the count value obtained by counting the number of the pulses of the first clock signal, wherein the decoding signal is used to set an output timing of the digital video data stored in the shift register;

a plurality of data registers which receives and stores the digital video data stored in the shift register based on the decoding signal;

a second divider which divides the transmission clock signal to generate a second clock signal; and a plurality of control signal generators which generates brightness control signals based on the second clock signal in response to the digital video data stored in the data registers to locally control a brightness of blocks of light sources of the plurality of light sources, wherein the transmission clock signal is directly applied to the first divider and second divider.

10. A liquid crystal display comprising:

a display unit comprising:

a liquid crystal display panel;

data circuits connected to the liquid crystal display panel; and gate circuits connected to the liquid crystal display panel;

a backlight device comprising a backlight unit including a plurality of light sources and a plurality of backlight control circuits which locally control a brightness of blocks of light sources of the plurality of light sources, wherein backlight control circuits of the plurality of backlight control circuit comprise:

a shift register which receives and stores digital video data based on a transmission clock signal input to the shift register, the digital video data based on a video signal having a predetermined period;

a first divider which divides the transmission clock signal to generate a first clock signal;

a counter/decoder which initializes a count value based on a vertical synchronization signal, counts a number of pulses of the first clock signal, and outputs a decoding signal obtained by decoding the count value obtained by counting the number of pulses of the first clock signal, wherein the decoding signal is used to set an output timing of the digital video data stored in the shift register;

a plurality of data registers which receives and stores the digital video data stored in the shift register based on the decoding signal;

a second divider which divides the transmission clock signal to generate a second clock signal; and a plurality of control signal generators which generates brightness control signals based on the second clock signal in response to the digital video data stored in the data registers to locally control the brightness of the blocks of light sources, wherein the transmission clock signal is directly applied to the first divider and the second divider.

* * * * *